US010190238B2

(12) United States Patent
Schmid et al.

(10) Patent No.: US 10,190,238 B2
(45) Date of Patent: Jan. 29, 2019

(54) BALE OPENER

(71) Applicant: Maschinenfabrik Rieter AG, Winterthur (CH)

(72) Inventors: Alexander Schmid, Winterthur (CH); Gerhard Gschliesser, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 599 days.

(21) Appl. No.: 14/884,861

(22) Filed: Oct. 16, 2015

(65) Prior Publication Data

US 2016/0108559 A1 Apr. 21, 2016

(30) Foreign Application Priority Data

Oct. 16, 2014 (CH) ..... 1581/14

(51) Int. Cl.
*D01G 7/12* (2006.01)
*D01G 7/14* (2006.01)

(52) U.S. Cl.
CPC ..... *D01G 7/12* (2013.01); *D01G 7/14* (2013.01)

(58) Field of Classification Search
CPC .. D01G 7/00; D01G 7/14; D01G 7/10; D01G 7/02
USPC ..... 19/80 R, 82–83
See application file for complete search history.

(56) References Cited

U.S. PATENT DOCUMENTS 1,101,598 A * 6/1914 Weinke ..... B66B 9/025 187/233
3,688,920 A * 9/1972 Frish ..... B65G 57/00 187/267
4,100,651 A * 7/1978 Wornall ..... D01G 13/00 19/145.5
4,297,766 A * 11/1981 Trutzschler ..... D01G 13/00 191/145.5
4,446,602 A * 5/1984 Marx ..... D01G 31/00 19/0.21
4,455,714 A * 6/1984 Goldammer ..... D01G 13/00 19/145.5
4,467,502 A * 8/1984 Lytton ..... D01G 23/08 19/145.5

(Continued)

FOREIGN PATENT DOCUMENTS

CH 686188 A5 1/1996
CN 202323189 U 7/2012

(Continued)

OTHER PUBLICATIONS

Swiss Patent Office Search Report, dated Jan. 16, 2015.
EP Search Report, dated Mar. 1, 2016.

*Primary Examiner* — Shaun R Hurley
*Assistant Examiner* — Bao-Thieu L Nguyen
(74) *Attorney, Agent, or Firm* — Dority & Manning, P.A.

(57) ABSTRACT

A bale opener for the take-off of fiber tufts from fiber bales includes a take-off tower, which is arranged on a horizontal drive or a rotating frame, and a take-off arm. The take-off arm is held on the take-off tower in a guide so as to be vertically adjustable. A single lifting spindle having a longitudinal axis in the movement direction of the take-off arm is provided for the vertical adjustment of the take-off tower. The lifting spindle is fastened on the take-off tower and the take-off arm is connected to the lifting spindle via a nut.

9 Claims, 3 Drawing Sheets

(56) References Cited

U.S. PATENT DOCUMENTS 4,475,270 A * 10/1984 Hergeth ..... D01G 7/10 19/81
4,493,131 A * 1/1985 Dragagna ..... D01G 7/14 19/145.5
4,507,826 A * 4/1985 Keller ..... D01G 7/04 19/80 R
4,514,881 A * 5/1985 Hergeth ..... D01G 7/10 19/80 R
4,557,021 A * 12/1985 Nash ..... D01G 23/08 19/145.5
4,595,149 A * 6/1986 Hergeth ..... D01G 7/10 19/80 R
4,660,257 A * 4/1987 Binder ..... D01G 7/10 19/300
4,678,128 A * 7/1987 Hergeth ..... D01G 7/04 104/161
4,707,888 A 11/1987 Binder et al.
4,739,669 A * 4/1988 Yokose ..... B23Q 5/404 384/519
4,884,319 A * 12/1989 Schmidt ..... D01G 7/14 19/80 R
4,917,796 A * 4/1990 Rudzinski ..... B01D 29/03 210/159
4,993,119 A * 2/1991 Roberson ..... D01G 7/08 19/105
4,995,142 A * 2/1991 Binder ..... D01G 7/10 19/80 R
5,011,511 A 4/1991 Beck
5,044,047 A * 9/1991 Schwager ..... B65H 54/80 19/159 R
5,064,337 A * 11/1991 Asakawa ..... H01L 21/67769 414/274
5,079,800 A * 1/1992 Leifeld ..... D01G 7/14 19/80 R
5,090,090 A * 2/1992 Temburg ..... D01G 7/10 19/80 R
5,097,716 A * 3/1992 Barbat ..... B23Q 1/267 248/657
5,105,507 A * 4/1992 Staheli ..... D01G 7/10 19/80 R
5,121,418 A * 6/1992 Staheli ..... D01G 7/10 377/24.1
5,195,391 A * 3/1993 Barbat ..... B23Q 1/267 248/657
5,285,552 A 2/1994 Leifeld et al.
5,323,513 A * 6/1994 Binder ..... D01G 31/00 19/65 A
5,367,748 A * 11/1994 Leifeld ..... D01G 7/10 19/80 R
5,419,410 A * 5/1995 Yanagisawa ..... B65G 35/00 186/49
5,481,936 A * 1/1996 Yanagisawa ..... B23Q 1/52 108/139
5,495,642 A * 3/1996 Trutzschler ..... D01G 7/14 19/80 R
5,564,165 A * 10/1996 Zander ..... D01G 7/10 19/80 R
5,853,243 A * 12/1998 Duggan ..... A23G 4/02 366/76.9
5,878,844 A * 3/1999 Carter ..... B66F 9/063 187/226
6,050,770 A * 4/2000 Avitan ..... B66F 17/003 187/242
6,056,429 A * 5/2000 Duggan ..... A23G 4/02 366/148
6,170,341 B1 * 1/2001 Avitan ..... B66F 17/003 73/862.392
6,335,508 B1 * 1/2002 Nam ..... B23D 21/00 219/121.67
6,497,008 B1 * 12/2002 Schlepfer ..... D01G 7/10 19/145.5
6,724,714 B1 * 4/2004 Kato ..... G11B 7/08582 720/672
7,506,410 B2 * 3/2009 Minter ..... D01G 7/06 19/105
7,579,720 B2 * 8/2009 Chou ..... H02K 41/02 310/12.19
8,303,234 B2 * 11/2012 Ezure ..... H05K 13/02 414/396
9,010,205 B2 * 4/2015 Schroeder ..... F16H 25/20 74/89.32
9,120,383 B2 * 9/2015 Jindo ..... B60L 5/005
9,500,224 B2 * 11/2016 Asher ..... F16C 29/0692
9,561,566 B2 * 2/2017 Putman ..... B23Q 1/4828
2003/0164179 A1 * 9/2003 Kamikawa ..... H01L 21/67781 134/25.4
2006/0137726 A1 * 6/2006 Sano ..... G03F 7/7075 134/61
2013/0160586 A1 * 6/2013 Johnson ..... F16H 57/0467 74/89.44
2015/0025757 A1 * 1/2015 Dumarey ..... A01F 15/046 701/50

FOREIGN PATENT DOCUMENTS

DE 2435290 A1 2/1976
DE 3210602 10/1982
EP 0199041 A1 10/1986
EP 1 571 244 A1 9/2005
EP 2 322 701 A1 5/2011
GB 1 431 365 4/1976
JP S63102772 U 7/1988
SU 32 342 A1 9/1933
WO WO 2009/062325 A1 5/2009

* cited by examiner

BALE OPENER

FIELD OF THE INVENTION

The invention relates to a bale opener for the take-off of fiber tufts from fiber bales, comprising a take-off tower, which is arranged on a horizontal drive or a rotating frame, and comprising a take-off arm.

BACKGROUND

Bale take-off machines or bale openers are used to extract fibers or fiber tufts from pressed fiber bales. To this end, a take-off unit is moved across the fiber bales. The take-off unit is fastened on a take-off arm, the height of which is set according to the fiber bales that are present. The take-off arm, in turn, is held on a take-off tower. The take-off tower makes it possible for the take-off unit to be moved across the surface of the fiber bales. To this end, the take-off tower is arranged on a horizontal drive or a rotating frame. A horizontal drive, which is usually guided on rails, is used to move across a row of bales. If the fiber bales are arranged in a circle around the take-off tower, the take-off tower is mounted on a rotating frame. A combination of a horizontal drive and a rotating frame is present when fibers or fiber tufts are extracted from a first row of fiber bales in one direction and from a second row of fiber bales in the opposite direction.

The bale opener is located at the beginning of processing lines in a spinning preparation (blowroom) for processing fiber material, for example cotton or synthetic fibers or mixtures thereof, and has a decisive influence on the continuity of the sequences that take place within the spinning preparation. In the bale opener, the fiber material delivered in bales is extracted from the bales by taking off fiber tufts and is transferred to a pneumatic transport system. The pneumatic transport system carries the fiber tufts through pipelines to the downstream cleaning machines.

In bale openers that are common today, the take-off arm is held on the take-off tower so as to be vertically adjustable. The vertical adjustment is usually carried out by means of chain or belt drives, at which the take-off arm is raised or lowered. Sensors are provided on the take-off arm in order to determine the position of the take-off arm relative to the surface of the fiber bales.

Various embodiments of lifting mechanisms for take-off arms are known from the prior art. For example, CH 686 188 A5 discloses a take-off arm comprising a chain drive for vertical adjustment. The take-off arm is suspended on a counter-weight via a cable and deflection rollers, wherein the height of the take-off arm is adjusted by means of a lifting motor via a chain drive.

A bale opener is disclosed in CH 675 386 A, which moves the take-off arm in a circular manner over the fiber bales to be opened. In so doing, the take-off arm is moved in the vertical position thereof via four threaded rods located at the corners. The threaded rods are rotated simultaneously in order to raise or lower the take-off arm. The threaded rods are connected via a gearbox in order to ensure a synchronized movement of the threaded rods.

The disadvantage of the disclosed design according to the prior art is the complex construction of the lifting mechanisms, which either make it necessary to provide a suspension that is independent of the actual movement, or the lifting mechanisms must have a plurality of lifting drives, which move the take-off arm simultaneously. As a result, an exact orientation of the take-off arm relative to the fiber bales to be opened is complicated and, due to operation-induced wear, a readjustment must be carried out periodically. In addition, a complex sensor system is required for the positioning and control of the lifting mechanism.

SUMMARY OF THE INVENTION

An object of the invention is to create a bale opener comprising a take-off arm, which permits an easily controlled vertical adjustment of the take-off arm and avoids the need for a separate suspension or a synchronized movement in various drive points. Additional objects and advantages of the invention will be set forth in part in the following description, or may be obvious from the description, or may be learned through practice of the invention.

In order to solve the problem, a novel vertical adjustment of the take-off arm having a single lifting spindle is proposed. The bale opener for the take-off of fiber tufts from fiber bales comprises a take-off tower, which is arranged on a horizontal drive or a rotating frame, and a take-off arm, wherein the take-off arm is held on the take-off tower in a guide so as to be vertically adjustable. A single lifting spindle having a longitudinal axis in the movement direction of the take-off arm is provided for the vertical adjustment of the take-off arm, wherein the lifting spindle is fastened on the take-off tower and the take-off arm is connected to the lifting spindle via a nut.

A single lifting spindle, for example a threaded spindle, is provided in the take-off tower. The lifting spindle is fastened on the take-off tower so as to be fixed or rotatable, wherein the fastening is designed such that the lifting spindle extends via the longitudinal axis thereof in the vertical movement direction of the take-off arm. The take-off arm is connected to the lifting spindle via a nut. By rotating the lifting spindle when the nut is fixed or rotating the nut when the lifting spindle is fixed, the take-off tower is moved downward or upward along the longitudinal axis depending on the direction of rotation.

Advantageously, the take-off arm is connected to the lifting spindle via a recirculating ball nut. A ball screw drive therefore results from the combination of the recirculating ball nut and the lifting spindle. Balls move between the lifting spindle and the nut in raceways, said balls traveling axially during rotation. A return channel in the recirculating ball nut returns the balls and therefore closes the circuit in which the balls circulate. Ball screw drives have the advantage over screw drives that a point contact of the balls and the rolling motion thereof reduce the need for drive power and enable more accurate positioning. The ball screw drive can be adjusted so as to be virtually play-free and therefore enables an exact execution of minute movements of the take-off arm in the direction of the longitudinal axis of the lifting spindle.

In addition, it is advantageous when the guide of the take-off arm in the take-off tower is designed such that the lifting spindle is loaded with forces only in the longitudinal axis thereof.

Particularly advantageously, the take-off arm is held in guide rails on the take-off tower. The guide rails are designed such that all transverse forces and tilting moments of the overhanging take-off arm are absorbed by the guide. The structure of the guide rails is designed such that the only movement possible for the take-off arm is in the longitudinal axis of the lifting spindle and the forces are absorbed by the guide in two linear axes and three rotational axes. The guide rails can be designed as simple longitudinal profiles. In this case, gliding elements or rollers are placed against the guide rails from three sides, wherein the gliding elements or rollers are installed on the take-off arm.

Since all the transverse forces and tilting moments that result from the overhanging arrangement of the take-off arm are absorbed by the guide of the take-off arm in the take-off tower, it does not matter exactly where the lifting spindle is located. The lifting spindle can be located on the side of the take-off arm, which provides advantages for the positioning of a fiber transport channel within the take-off arm and the take-off tower. The lifting spindle is preferably located outside of the centroid axes of the take-off arm. Given such an arrangement, the take-off arm tilts in a predetermined direction, thereby resulting in a defined position in the guide. Given that a tilting moment acts on the guide in a direction that is determined by the arrangement of the lifting spindle, it is possible to achieve a play-free setting of the guide.

Advantageously, two mutually spaced, U-shaped guide rails can be arranged on the take-off tower with the longitudinal axis thereof oriented in the movement direction of the take-off tower. The openings of the U-shaped guide rails point in the direction of the respectively opposite guide rail. Guide elements, for example rollers or gliding elements, are fastened on the take-off arm and are placed against the guide rails of the take-off tower. The guide elements are designed such that the take-off arm is prevented from tilting about the two horizontal axes of the take-off arm. In addition, the guide elements bring about a lateral guidance of the take-off arm in the vertical movement direction thereof. Rollers or gliding elements are installed on the take-off arm and are placed against the guide rails of the guide in the take-off arm such that play-free guidance of the take-off arm is given.

It is particularly advantageous when the fastening of the lifting spindle on the take-off tower is provided only at an upper end of the lifting spindle and, at a lower end, the lifting spindle is not held in the take-off tower. This type of fastening of the lifting spindle, which is similar to a suspension, results in optimal conditions for the operation of the ball screw drive. Fixing the lifting spindle via an upper and a lower fastening can result in transverse forces acting on the recirculating ball drive, due to temperature differences or stresses that occur.

Preferably, the lifting spindle is held in the take-off tower in a rotationally locked manner and the recirculating ball nut is provided with a drive. The recirculating ball nut, which establishes a connection between the take-off arm and the lifting spindle, is set into rotation by a drive and induces a movement of the take-off arm in the direction of the longitudinal axis of the lifting spindle. The use of a synchronous servo-motor for the drive of the recirculating ball nut is particularly advantageous. Such a drive has the advantage that a certain number of revolutions or parts of revolutions can be carried out. Preferably, the lifting spindle is enclosed on both sides of the recirculating ball nut by a protective casing, for example a bellows, the longitudinal extension of which adapts to the particular position of the recirculating ball nut on the spindle.

Advantageously, the vertical position of the take-off arm is determined by means of sensors in the drive by determining the revolutions completed. This also makes a defined vertical adjustment of the take-off arm possible. The vertical position of the take-off arm is given by the drive, and is adjustable, after an initial calibration. Complex sensors, such as, e.g., light barriers or displacement measurements, are therefore no longer needed in order to adjust the height of the take-off arm. Nor is there any need to move to reference points. Synchronous servo-motors also have the property that the highest possible torque is already available at start-up, thereby making it possible for the take-off arm to move within minute ranges.

Preferably, the lifting spindle is fastened in the take-off tower via a load cell. In this case, the lifting spindle is suspended on a load cell, which is fastened on the take-off tower. Since the take-off tower is suspended, in turn, on the lifting spindle via the recirculating ball nut, the weight of the take-off arm and the lifting spindle, which are fastened on the load cell, can be determined via the load cell.

The dimension of the lifting spindle and the pitch, inter alia, are decisive factors for the precision with which the lifting mechanism of the take-off arm can be operated. The pitch is measured as the length of the displacement that the recirculating ball nut travels during one revolution of the lifting spindle. It has been shown that lifting spindles having a diameter of 20 mm to 75 mm are suitable for continuous operation; preferably, the diameter of the lifting spindle is selected to be between 30 mm and 50 mm. When a recirculating ball nut is used, the pitch of the lifting spindle is advantageously 5 mm to 40 mm, particularly preferably 10 mm to 20 mm. When a threaded nut is used, multiple-start lifting spindles are advantageous.

In addition, it is advantageous when the guide comprises at least one combination roller. A combination roller replaces two rollers, which are arranged in mutually orthogonal axes, and therefore has the advantage of bringing about a space-saving arrangement of the necessary guide rollers. The combination roller is composed of a transverse guide roller and a longitudinal guide roller, which have a common pivot pin for holding the combination roller in a rotationally locked manner. The transverse guide roller rotates about the axis that also determines the position of the pivot pin. Guidance transversely to the axis of the pivot pin results, due to the arrangement of the transverse guide roller. The longitudinal guide roller, however, rotates in an axis, which is arranged transversely (orthogonally) to the axis of the pivot pin and brings about guidance in the direction of the axis of the pivot pin via the surface of said longitudinal guide roller. Preferably, four combination rollers are used. In this case, the combination rollers are fastened on the take-off arm or on the take-off tower in a rectangular arrangement.

Bale openers comprising one or more take-off rollers are known from the prior art. The embodiment of the bale opener according to the invention is independent of whether one or more take-off rollers are used.

BRIEF DESCRIPTION OF THE DRAWINGS

The invention shall be described in greater detail in the following by means of an exemplary embodiment and by reference to drawings.

DETAILED DESCRIPTION

Figure 1:
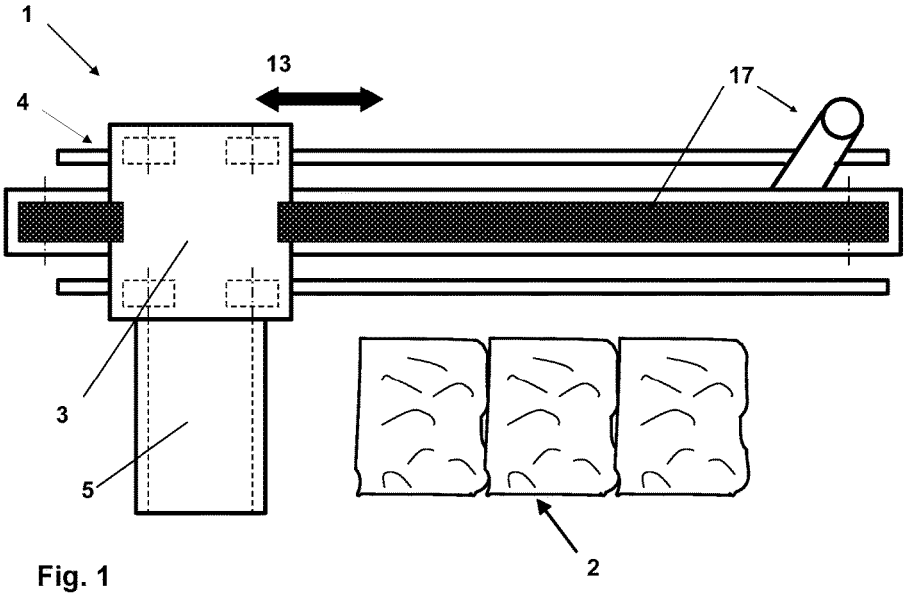
FIG. 1 shows a schematic illustration of a top view of a bale opener.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
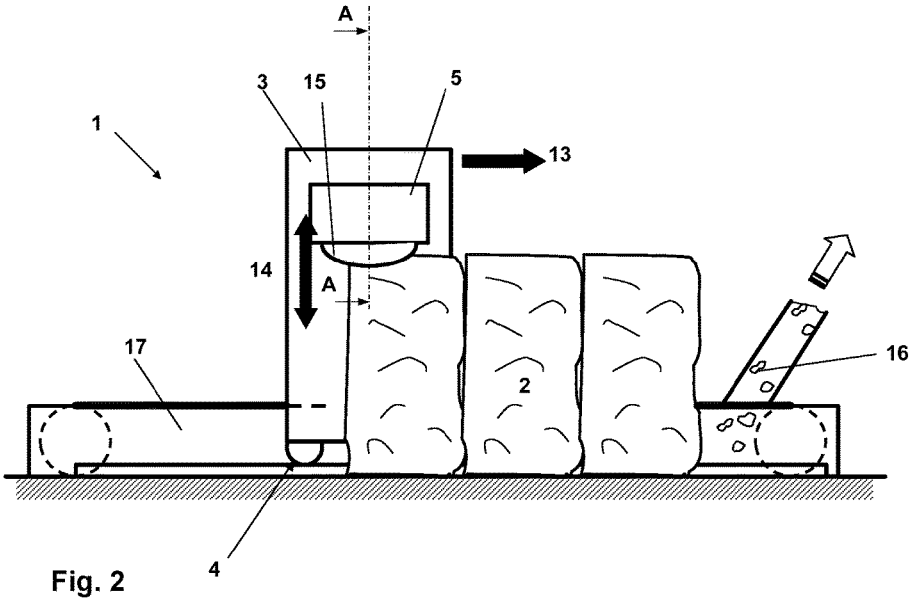
FIG. 2 shows a schematic illustration of a view of a bale opener.

FIG. 1 and FIG. 2 show a schematic illustration of a bale opener 1 for the take-off of fiber tufts from fiber bales 2. FIG. 1 shows the bale opener 1 in a top view and FIG. 2 shows this in a side view. The bale opener 1 substantially consists of a take-off tower 3 and a take-off arm 5. The take-off arm 5 is fastened on the take-off tower 3 on one side and is arranged so as to overhang freely over the fiber bales 2. The take-off tower 3 is equipped with a horizontal drive 4. The take-off tower 3 is moved on rails along the fiber bales 2 by means of the driving mechanism 4. The take-off arm 5 mounted on the take-off tower 3 is guided over the surface of the fiber bales 2 by means of this movement 13. A take-off unit, usually one or more take-off rollers 15, is arranged in the take-off arm 5. The take-off roller 15 extracts fiber tufts 16 from the fiber bales 2. The fiber tufts 16 are transported through the take-off arm 5 and the take-off tower 3 and to a pneumatic fiber tuft transport system 17. The fiber tuft transport system 17 and, therefore, the transport path from the take-off roller 15 to the fiber tuft transport system 17, have a certain underpressure, which serves to pneumatically convey the fiber tufts from the take-off roller 15 through the fiber tuft transport system 17.

The fastening of the take-off arm 5 on the take-off tower 3 is designed to be vertically adjustable such that the fiber bales 2 can be continuously opened. The movement 14 of the take-off tower 5 is used ensure a uniform take-off of the fiber tufts 16 from the surface of the fiber bales 2.

Figure 3:
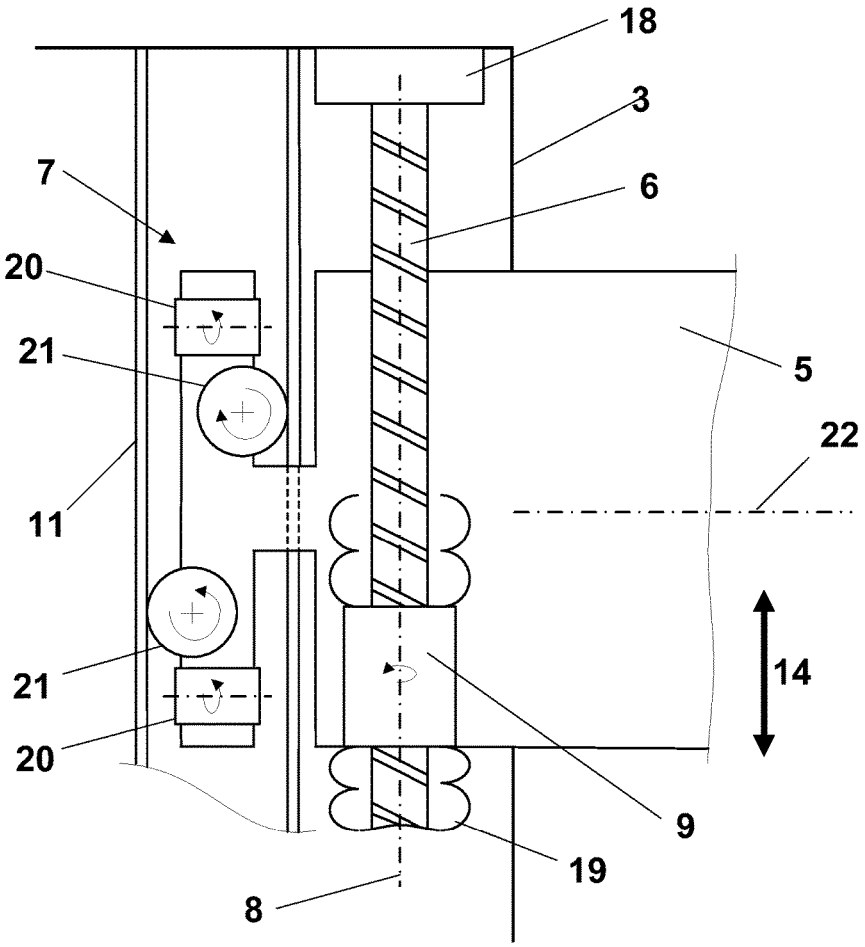
FIG. 3 shows a schematic sectional illustration A-A according to FIG. 2.

FIG. 3 shows a schematic view of the take-off arm 5 in a sectional illustration A-A according to FIG. 2. The take-off arm 5 is illustrated schematically and only partially, and without the take-off roller. The lifting mechanism for the movement 14 of the take-off arm 5 is shown in an embodiment presented as an example. A recirculating ball nut 9 is fastened on the take-off arm 5. The recirculating ball nut 9 surrounds a lifting spindle 6. The recirculating ball nut 9 is held, via the housing thereof, on the take-off arm 5 in a rotationally locked manner. The recirculating ball nut 9 is set into rotation by a drive (not shown), whereby said recirculating ball nut, together with the take-off arm 5, moves along the lifting spindle 6. The lifting spindle 6 is held, via the upper end thereof, on the take-off tower 3 in a rotationally locked manner by means of a fastening 18. The lifting spindle 6 is suspended in the fastening 18 such that the lifting spindle 6 does not need to be secured at the lower end. The lifting spindle 6 is surrounded by a bellows 19 both above and below the recirculating ball nut 9. The bellows 19 automatically adapts to the particular length of the section of the lifting spindle 6 and prevents interference with the ball screw drive by contaminations of the thread grooves of the lifting spindle 6.

The guide 7 of the take-off arm 5 is also held in the take-off tower 3. The guide is composed of two opposing, U-shaped (i.e., parallel legs and a closed end) guide rails 8 and the transverse rollers 20 and the longitudinal rollers 21 provided on the take-off arm 5. The transverse rollers 20 and the longitudinal rollers 21 are arranged in pairs on each side of the guide 7 and engage into guide rail 8. The transverse rollers 20 touch the U-shaped guide rail 8 in the rear flange thereof, which is fastened on the take-off tower 3. The take-off arm is guided in the transverse direction by the transverse rollers 20. In addition, the transverse rollers 20 prevent the take-off arm 5 from rotating about the longitudinal axis 22 thereof. The longitudinal rollers 21 are arranged so as to be offset relative to one another and said longitudinal rollers touch the U-shaped guide rails 8 in the webs protruding from the rear flange. The longitudinal rollers 21 are used to position the take-off arm 5 in the longitudinal axis 22 of the take-off arm 5 and to thereby hold said take-off arm horizontal, and are used simultaneously to prevent the take-off arm from rotating about the longitudinal axis 8 of the lifting spindle 6. The directions of rotation indicated with arrows in the longitudinal rollers 21 and the transverse rollers 20 result in the case of an upward movement 14 of the take-off arm 5. Instead of the use of the individual transverse rollers 20 and the longitudinal rollers 21, it is possible to combine one transverse roller 20 and one longitudinal roller 21 in each case to form a combination roller having a common pivot pin.

Figure 4:
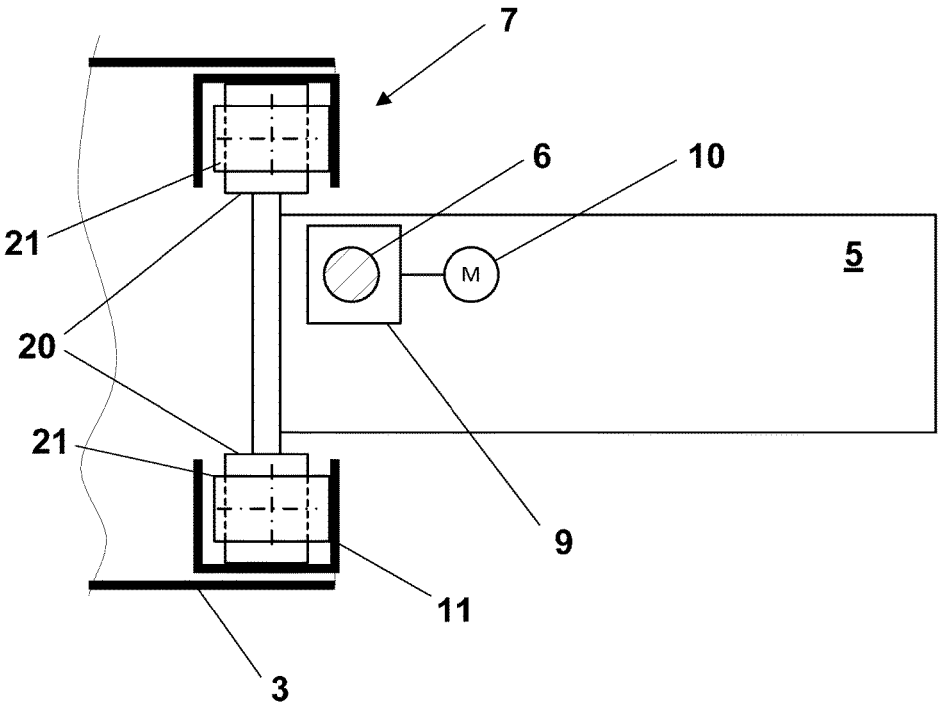
FIG. 4 shows a schematic illustration of a top view according to FIG. 3.

FIG. 4 shows a schematic top view of the take-off arm 5 according to FIG. 2. The take-off arm 5 is held, via the guide 7, on the take-off tower 3 so as to overhang freely. The guide 7 comprises two opposing, U-shaped guide rails 8, which are fastened on the take-off tower 3, and transverse rollers 20 and longitudinal rollers 21, which are arranged in pairs and are held on the take-off arm 5. Only two opposing pairs of transverse and longitudinal rollers 20, 21 are shown in the illustration according to FIG. 4. However, two pairs of transverse and longitudinal rollers 20, 21, which are arranged one on top of the other, are also located on both sides (see FIG. 3). The lifting spindle 6, which is surrounded by the recirculating ball nut 9, extends through the take-off arm 5. It is also conceivable to locate the lifting spindle 6 outside of the take-off arm 5, since the lifting spindle only needs to support forces in the longitudinal axis thereof and the location therefore plays a subordinate role.

The recirculating ball nut 9 is connected to a drive 10, which is fastened in the take-off arm. The recirculating ball nut 9 is set into rotation by the drive 10, which results in a lifting or lowering of the take-off arm 5, depending on the direction of rotation. The transverse rollers 20 and the longitudinal rollers 21 are thereby moved about their axes in the guide rails 8 and hold the take-off arm 5 on the trajectory predefined by the guide rails 8. Instead of the transverse and longitudinal rollers 20, 21, it is also possible to use gliding elements having corresponding dimensions.

Modifications and variations can be made to the embodiments illustrated or described herein without departing from the scope and spirit of the invention as set forth in the appended claims.

LEGEND

1 bale opener
2 fiber bales
3 take-off tower
4 horizontal drive
5 take-off arm
6 lifting spindle
7 guide
8 longitudinal axis of the lifting spindle
9 recirculating ball nut
10 drive
11 guide rail
13 movement of the take-off tower
14 movement of the take-off arm
15 take-off roller
16 fiber tufts
17 fiber tuft transport system
18 fastening

19 bellows
20 transverse roller
21 longitudinal roller
22 longitudinal axis of the take-off arm

The invention claimed is:

1. A bale opener for take-off of fiber tufts from fiber bales, comprising:

a take-off tower arranged on a horizontal drive or a rotating frame;

a take-off arm held on the take-off tower in a guide so as to be vertically adjustable along the take-off tower;

a single lifting spindle fastened on the take-off tower for vertical adjustment of the take-off arm, the lifting spindle having a longitudinal axis in the movement direction of the take-off arm;

the lifting spindle fastened on the take-off tower at an upper end of the lifting spindle, wherein a lower end of the lifting spindle is not held in the take-off tower;

the take-off arm connected to the lifting spindle via a recirculating ball nut; and the nut provided with the drive and the lifting spindle held in a rotationally locked manner.

2. The bale opener according to claim 1, wherein the take-off arm is engaged with the guide such that the lifting spindle is loaded with forces only in a direction of the longitudinal axis of the lifting spindle.

3. The bale opener according to claim 1, wherein the guide comprises at least two mutually spaced guide rails fastened on the take-off tower in a direction of the longitudinal axis of the lifting spindle, the guide rails comprising opposite parallel legs and a closed end.

4. The bale opener according to claim 1, wherein the lifting spindle is located on the take-off arm at a position to generate a predetermined tilt on the take-off arm.

5. The bale opener according to claim 1, further comprising rollers or gliding elements installed on the take-off arm and engaged against the guide in the take-off tower to provide play-free guidance of the take-off arm.

6. The bale opener according to claim 1, wherein the drive is a synchronous servo-motor.

7. The bale opener according to claim 6, wherein the drive comprises sensors that determine the vertical position of the take-off arm and are used to perform a defined vertical adjustment of the take-off arm as a function of sensed revolutions of the nut.

8. The bale opener according to claim 1, wherein the lifting spindle is fastened on the take-off tower via a load cell at an upper end of the lifting spindle.

9. The bale opener according to claim 1, wherein the guide comprises at least two mutually spaced guide rails fastened on the take-off tower in a direction of the longitudinal axis of the lifting spindle, and a plurality of transverse and longitudinal combination rollers engaged against the guide rails, the guide rails comprising opposite parallel legs and a closed end.

* * * * *